United States Patent [19]

Häfele et al.

[11] Patent Number: 5,063,634

[45] Date of Patent: Nov. 12, 1991

[54] FLOOR NOZZLE FOR A VACUUM CLEANER

[75] Inventors: Siegfried Häfele, Esslingen-Zell; Gernot Jacob, Weissach, both of Fed. Rep. of Germany

[73] Assignee: Progress Elektrogerate GmbH, Nurtingen, Fed. Rep. of Germany

[21] Appl. No.: 472,834

[22] Filed: Jan. 31, 1990

[30] Foreign Application Priority Data

Feb. 14, 1989 [DE] Fed. Rep. of Germany ..... 3904396

[51] Int. Cl.[5] ..... A47L 5/36

[52] U.S. Cl. ..... 15/377; 15/325; 15/339; 15/383

[58] Field of Search ..... 15/377, 339, 387, 383, 15/352, 325

[56] References Cited

U.S. PATENT DOCUMENTS

| | | | |
|---|---|---|---|
| 2,683,276 | 7/1954 | Olsen | 15/387 |
| 3,253,294 | 5/1966 | Waters | 15/323 |
| 3,482,276 | 12/1969 | Fillery | 15/392 X |
| 3,916,476 | 11/1975 | Johnson et al. | 15/377 |
| 4,980,945 | 1/1991 | Bewley | 15/377 X |

FOREIGN PATENT DOCUMENTS

| | | | |
|---|---|---|---|
| 960576 | 6/1964 | United Kingdom | 15/377 |

*Primary Examiner*—Chris K. Moore

*Attorney, Agent, or Firm*—Pearne, Gordon, McCoy & Granger

[57] ABSTRACT

In a floor nozzle for a vacuum cleaner the nozzle housing is provided with a substantially closed bottom, and it has in its upper housing portion a lockable opening, through which the suction chamber and the mechanical driving members of the cleaning means are accessible when the floor nozzle is in the operating position. The opening is locked by a cover which is hinged on the forward front face of the nozzle housing.

10 Claims, 4 Drawing Sheets

FLOOR NOZZLE FOR A VACUUM CLEANER

FIELD OF THE INVENTION

The present invention relates to a floor nozzle for vacuum cleaners, in particular an electric or turbo floor nozzle with a driven, roller-like cleaning means which is rotatably supported in the suction chamber of the nozzle housing and which partially passes through a slot disposed in the bottom of the housing.

DESCRIPTION OF THE BACKGROUND ART

An electric floor nozzle of the above described kind has been disclosed in U.S. Pat. No. 3,167,802. In that floor nozzle a rotatably supported brush roller is arranged in the front area of the nozzle housing, and it is driven by an electric motor in a way that the rotary movement of the motor shaft is transferred to the brush roller via a V-belt. The open underside of the nozzle housing is covered by a cover which is screwed to the nozzle housing. In the area of the brush roller said cover has a slot opening, whereby bristles of the brush roller protrude through the slot opening and can accordingly treat the floor surface to be cleaned.

When floor nozzles are used, it happens relatively often that hairs, lint and the like which are taken up by the brush get caught in the bristles and possibly wind around the roller. This may soon cause not only obstructions by which the suction effect of the vacuum cleaner is reduced considerably, but also a blocking of the roller brush, something that may damage the motor or the driving members. In such a case, the user must screw the bottom plate off the nozzle housing and remove the hair, lint and the like from the suction chamber and/or from the roller. Since the removal of the bottom plate is troublesome, regular maintenance and cleaning work that is actually necessary is done only at large time intervals or only just in those cases when the blocking of the brush roller results in a failure of the floor nozzle, so that appropriate maintenance or cleaning becomes then inevitable. This results in either that the floor nozzle is exposed to excessive wear, or that its capacity is reduced considerably. Another disadvantage resides in that when the bottom plate is opened and closed several times, it may happen that locking members get lost or the respective thread means in the housing are damaged, whereby after a relatively short time of use of the floor nozzle the tightness of the suction chamber is no longer guaranteed and the capacity of the floor nozzle decreases. For construction purposes, the bottom cover must be made relatively rigid because the brush roller bearings are inserted from below and are supported on the cover. Hereby the weight of the floor nozzle is increased. Since the underside of the floor nozzle is exposed to a higher wear, the bottom-sided cover is usually made of metal whilst the floor nozzle is otherwise made of plastics material. However, the use of the separate metal parts involves higher production costs. Generally speaking, the known floor nozzle is uncomfortable in respect of use and maintenance, and on the long run it looses more and more of its capacity.

OBJECT OF THE INVENTION

It is therefore the object of the present invention to improve a floor nozzle of the known kind in such a way that the above described disadvantages can be avoided, that is to say that the floor nozzle as simplified in construction is comfortable in respect of use and maintenance and that it does not suffer any losses of capacity over an extended period of use.

SUMMARY OF THE INVENTION

The above object of the invention is achieved in that the nozzle housing has a substantially closed bottom and that it has in its upper portion a lockable opening, through which the suction chamber and the mechanical driving members of the cleaning means are accessible when the floor nozzle is in the operating position. Advantageously, such opening is lockable by a cover which is hinged on the nozzle housing and which may be turned upside comfortably by the user any time in the feed direction of the nozzle housing, so that the suction chamber and the mechanical driving members are accessible for cleaning or for minor maintenance works that can be done by the user himself. Due to a design by which the cover can be opened upwards, all the constructional parts such as the brush roller, the drive with the tooth belt and bearings, can be introduced from the top, while for instance the bearing blocks are made of a self-lubricating plastics material and provided with two laterally disposed resilient tongues which are compressed automatically during assembly and then engage by a click-stop arrangement in their correct position. For removing the bearing, one needs only to compress these two resilient tongues, and then the bearing can be withdrawn to the top. Hence, it is easy for the user to withdraw the brush roller from the housing for removing wound-up threads, hairs and the like from the brush roller. Since the cover needs only to be turned upside, the construction is comfortable in use and enables the user to easily check the brush roller and the driving aggregates any time, for example after every vacuum cleaning operation, so that any loss of power of the floor nozzle can be avoided. Furthermore, the manufacturing costs of the floor nozzle according to the invention are low, because the housing parts are made of plastics and the cover fulfills substantially only the function of locking and therefore needs not be overly rigid. In the area of the cover portion facing the pipe socket of the floor nozzle, the cover has a gap which cooperates with a corresponding profile nose arranged on the pipe socket, whereby a stop means for the pipe socket is formed and the pipe can be moved into a parking position in a top dead center position. In this position the pipe takes a stable position, and since it is fixed in the straight direction, a rotary motion which would possibly make the pipe tilt over cannot take place either. The cover further fulfills the function of controlling a motor switch. When the cover is closed, the switch is switched in such a way that the floor nozzle is ready for operation, whereas the energy supply is interrupted by the switch and a temporary standstill of the brush roller is guaranteed when the cover is opened. The cover is hinged by means of film hinges which are spaced from each other on the forward housing front wall of the floor nozzle.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the claims given hereinbelow and the accompanying drawings which are given by way of illustration only, and thus are not limitative of the present invention, and wherein:

DETAILED DESCRIPTION OF PREFERRED EMBODIMENT(S)

Figure 7:
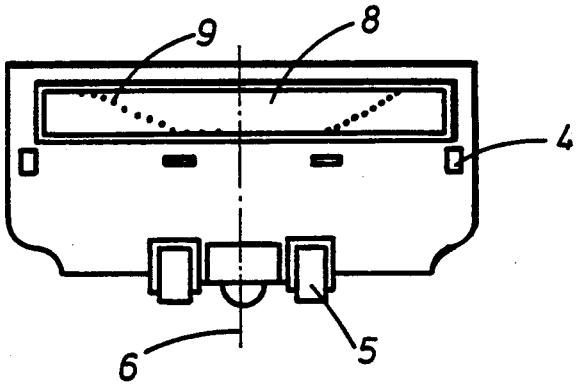
FIG. 7 is a schematic view of the floor nozzle according to the invention from below, in a reduced scale.

The floor nozzle for vacuum cleaners designated with the reference numeral 1 has a nozzle housing 2 with a generally closed bottom 3. The nozzle housing is supported on the floor by means of wheels 4, 5 which are arranged symmetrically in respect of the longitudinal center line 6 (see FIG. 7). In the forward part of the nozzle housing 2 there is a suction chamber 7, in which a brush roller 8 is rotatably supported, with at least the bristles 9 protruding through a slot 10 disposed in the bottom 3 of the housing for getting into touch with the floor surface 11, e.g. a wall-to-wall carpeting. The edges 12, 13 of the housing which limit the slot 10 laterally are reinforced by means of metal trims 14.

The brush roller 8 is inserted from above through an opening into the suction chamber 7, together with its bearing and driving parts 15 (which are not described further in detail) such as bearing blocks, resilient tongues as lateral guides, V-belts and the like. Said opening is closed by a cover 16 which overlaps substantially the entire housing of the floor nozzle.

On its inside the cover is stiffened by ribs 17 which engage into housing grooves 18 and which seal off the suction chamber 7 against the outside.

Figure 2:
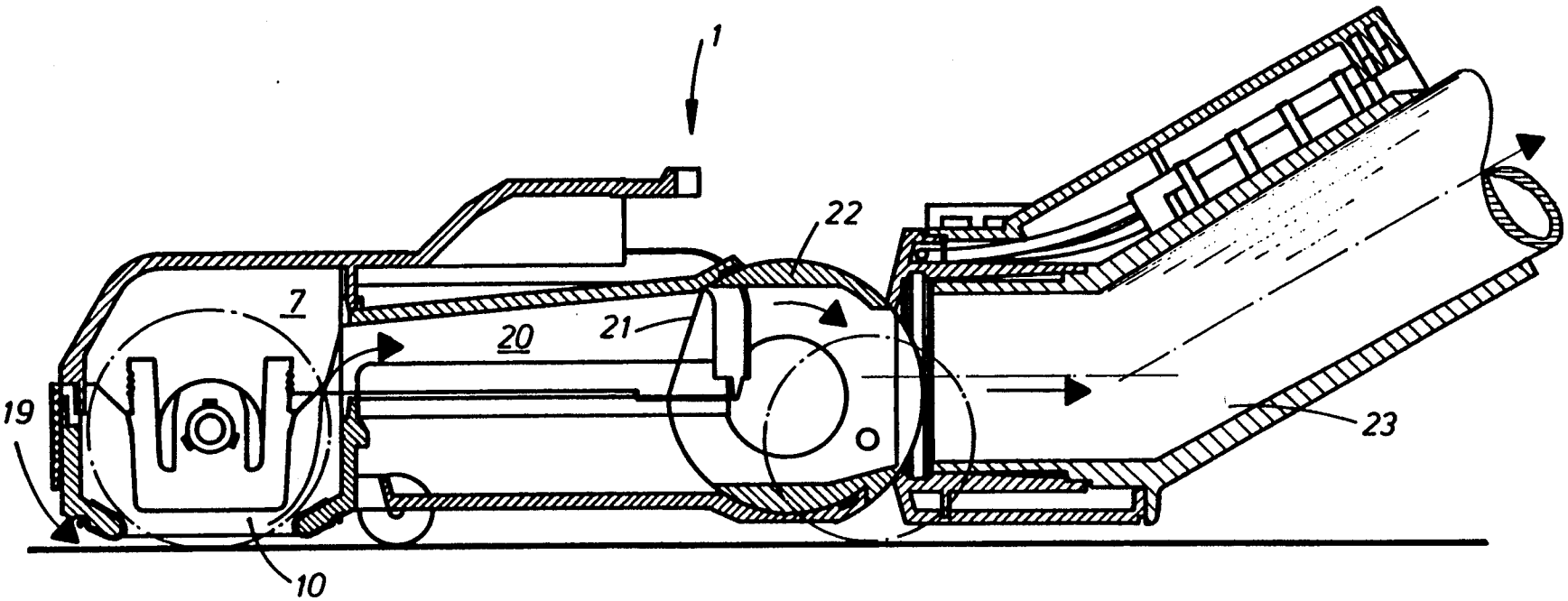
FIG. 2 is a view similar to that of FIG. 1, in which the pipe socket is in the operating position of the nozzle.
Figure 3:
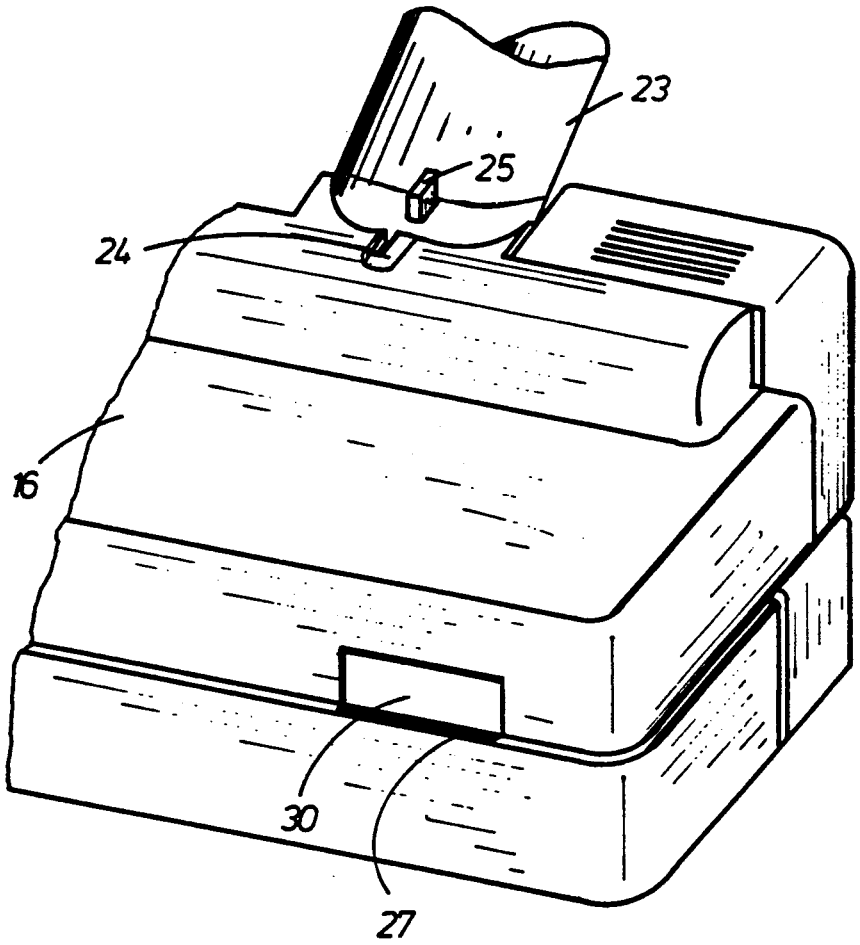
FIG. 3 is a perspective partial view of the floor nozzle according to the invention.
Figure 4:
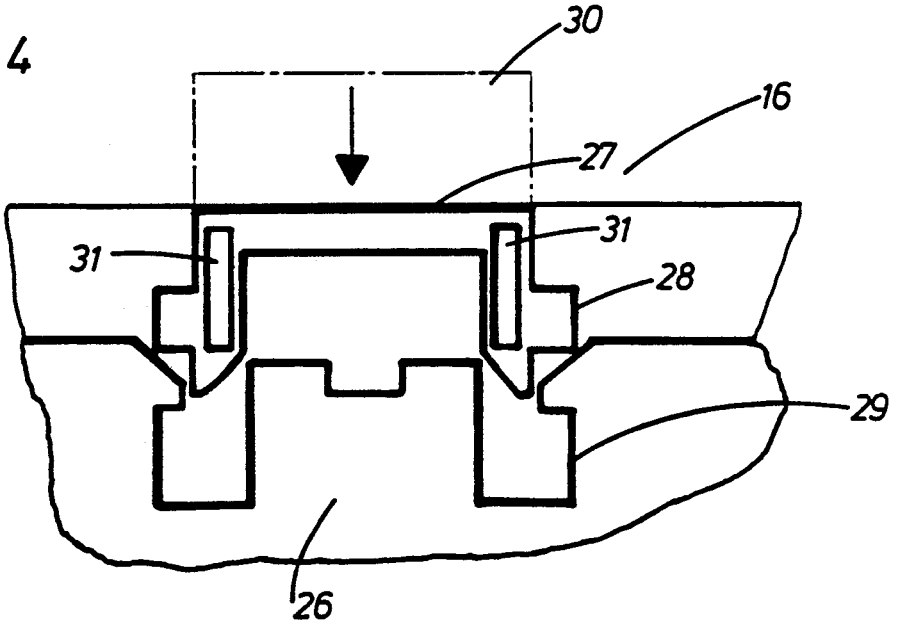
FIG. 4 is a schematic view of the fastening of the cover by means of a latchable film hinge.
Figure 5:
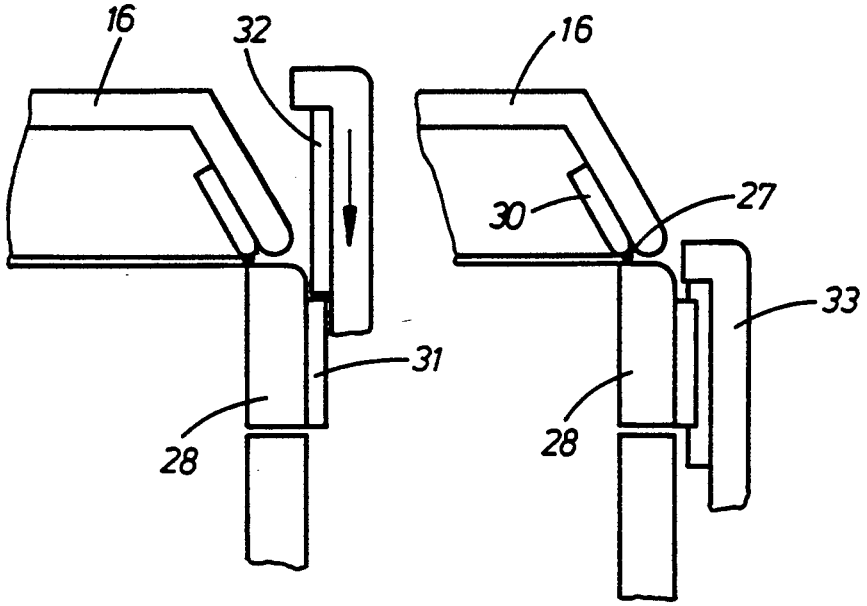
FIGS. 5 and 6 show alternative embodiments for the design of the cover hinge.

In the operating position of the floor nozzle as shown in FIG. 2 air flows in the direction of the arrows 19 through the slot 10 into the suction chamber 7, then it passes through the channel 20 around the suction port 21 of the swivel stub 22, wherefrom it continues flowing into the tilting stub 23 and a through a tube (not shown) to the vacuum cleaner.

Figure 1:
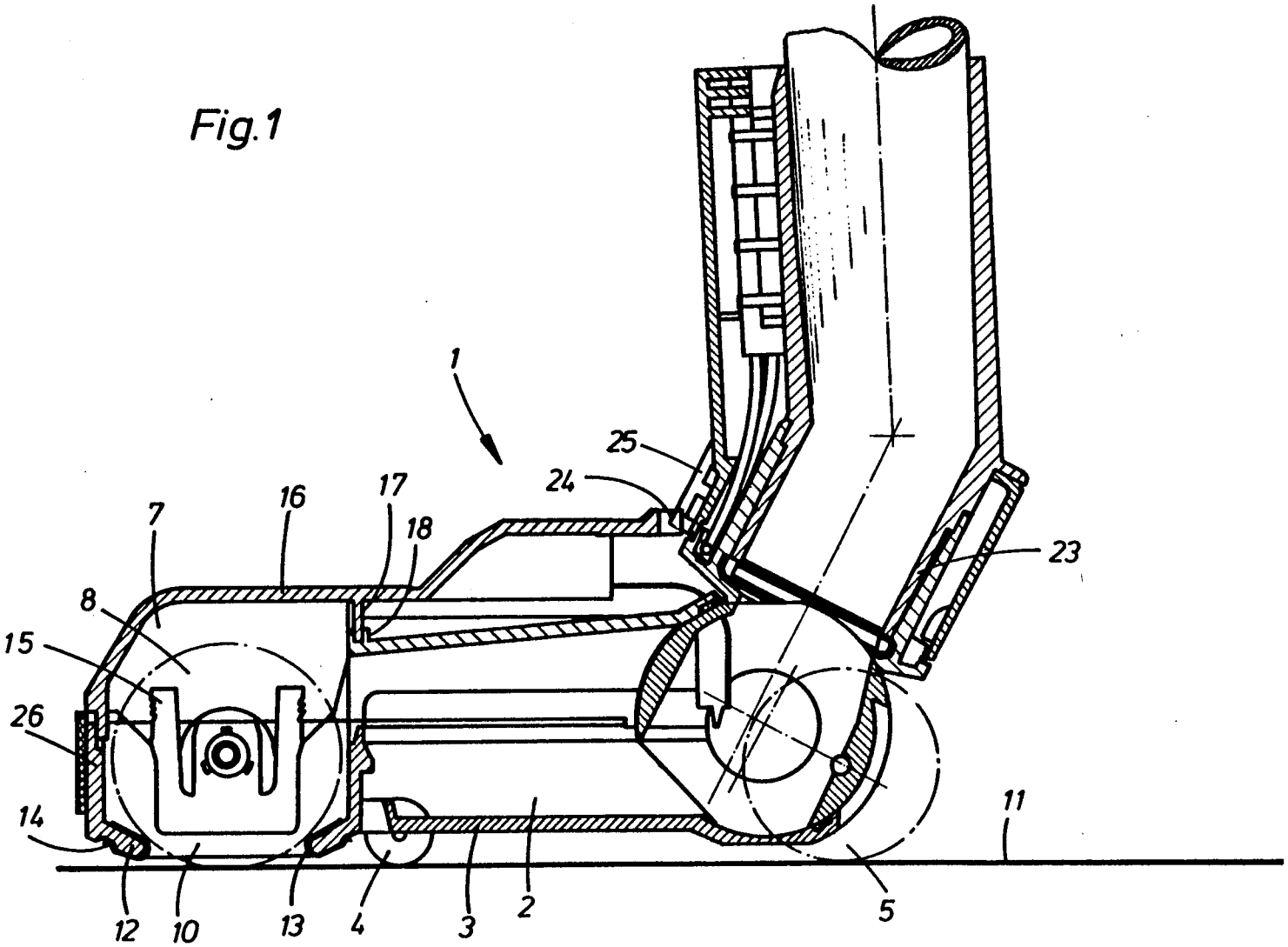
FIG. 1 is a schematic view of the floor nozzle according to the invention in longitudinal section, in which the pipe socket is in the approximately upright parking position.

The portion of the cover 16 which faces the stub is provided with a gap 24 which cooperates with a nose 25 fastened on the stub 23 so as to form a stop means with said nose. In FIG. 1 the nose 25 is in the engaged position in the gap 24, whereby the stub and the adjoining pipe are held in the parking position.

The cover 16 is hinged on the housing front face 26 by means of a film hinge 27 which is connected with at least one latch means 28 that can be engaged by a click-stop arrangement in a corresponding clearance 29 in the housing front face 26. The film hinge is screwed or glued to the inside of the cover 16 by means of a flat, plate-like flange 30.

On its forwardly-facing front side the latch means has guide members 31. Corresponding guide members 32 of a bumper profile member 33 are adapted to be slipped on said guide members 31. The bumper profile member 33 covers with an upper profile nose substantially the gap between the cover and the housing front face 26.

Figure 6:
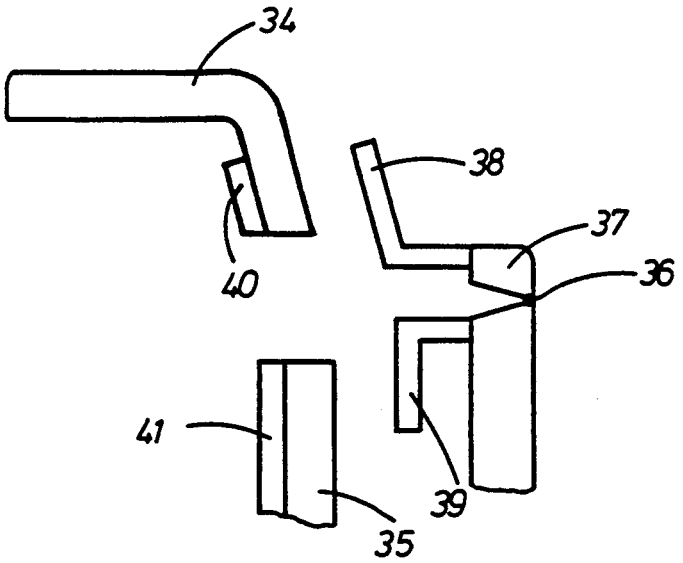

An alternative embodiment of the fastening of the cover 34 on the housing front face 35 is shown in FIG. 6, in which the film hinge 36 is an integrated part of the bumper profile member 37. The bumper profile member itself has guide members, 38, 39 which are adapted to be slipped into corresponding counter guide members 40, 41 which are attached on the cover 34 and on the housing front face 35 respectively.

We claim:

1. A floor nozzle for vacuum cleaners, in particular floor nozzle with a driven, roller-like cleaning means which is rotatably supported in the suction chamber of the nozzle housing and which partially protrudes through a slot disposed in the bottom of the housing, that nozzle housing having a substantially closed bottom and in its upper portion an opening, through which the suction chamber and the mechanical driving members of the cleaning means are accessible when the floor nozzle is in the operation position, said opening being closed by a cover which is hinged on the nozzle housing by at least one film hinge, characterized in that the cover is hinged on the forward front face of the nozzle housing, that one part of each film hinge is fastened to the cover, and that the other part of the film hinge is connected with at least one latch means which is adapted to engage by a click-stop arrangement into a corresponding clearance in the housing front face.

2. A floor nozzle according to claim 1, characterized in that the latch means is provided with guide means, to which a bumper profile member for the nozzle housing can be fastened.

3. A floor nozzle according to claim 1, characterized in that the film hinge is an integral part of a bumper profile member which is fastened to the cover and to the forward front wall of the nozzle housing.

4. A floor nozzle according to claim 3 characterized in that the bumper profile member is fastened to the cover and the nozzle housing respectively by a releasable groove/web connection.

5. A floor nozzle according to claim 1, 2 or 3, characterized in that the gap between the lower edge of the cover and the upper edge of the front wall of the housing is covered by a separate sealing profile.

6. A floor nozzle according to claim 1, characterized in that on its inside the cover is stiffened by ribs.

7. A floor nozzle according to claim 6, characterized in that at least one of the stiffening ribs encloses the suction chamber and that when the cover is closed said at least one of the stiffening ribs comes into tightening engagement with a means that is correspondingly arranged on the side facing of the housing.

8. A floor nozzle according to claim 1, characterized in that in the area of the cover portion which faces the pipe socket and one the side of the pipe socket which faces the cover there is provided a top means, by which the pipe can be locked in a substantially upright parking position.

9. A floor nozzle according to claim 1, characterized in that there is provided a resilient latch means, by which the cover is releasably held in its closed position on the housing.

10. A floor nozzle according to claim 1, characterized in that in its closed condition the cover engages a motor switch disposed on the housing side, whereby the motor is ready for operation when the cover is closed, and the energy supply is interrupted respectively when the cover is open.

* * * * *

UNITED STATES PATENT AND TRADEMARK OFFICE

CERTIFICATE OF CORRECTION

PATENT NO. : 5,063,634
DATED : November 12, 1991
INVENTOR(S) : Siegfried Hafele, et. al.

It is certified that error appears in the above-indentified patent and that said Letters Patent is hereby corrected as shown below:

Title page, under [56], third reference, "15/392X" should read --15/392XR--; fifth reference, "15/377X" should read --15/377XR--.

Column 4, line 31, "means" (second occurrence) should read --members--; line 42, "claim" should read --claims--; line 56, "one" should read --on--.

Signed and Sealed this
Sixth Day of July, 1993

Attest:

Michael K. Kirk

MICHAEL K. KIRK

Attesting Officer

Acting Commissioner of Patents and Trademarks